United States Patent [19]

Girard

[11] Patent Number: 4,696,487

[45] Date of Patent: Sep. 29, 1987

[54] SKI WHICH IS STIFF IN TORSION AND RELATIVELY WEAK IN BEAM

[76] Inventor: Donald A. Girard, P.O. Box 172, Rancho Cordova, Calif. 95670

[21] Appl. No.: 785,334

[22] Filed: Oct. 7, 1985

[51] Int. Cl.[4] ..... A63C 5/07

[52] U.S. Cl. ..... 280/602; 280/603

[58] Field of Search ..... 280/602, 603, 609

[56] References Cited

U.S. PATENT DOCUMENTS

| | | | |
|---|---|---|---|
| 2,188,582 | 1/1940 | Serr | 280/11.13 |
| 2,258,046 | 10/1941 | Clement | 280/11.13 |
| 3,260,531 | 7/1966 | Heuvel | 280/11.13 |
| 3,300,226 | 1/1967 | Reed, Jr. | 280/11.13 |
| 3,398,968 | 8/1968 | Mutzhas . | |
| 3,537,717 | 11/1970 | Caldwell | 280/11.13 |
| 3,601,421 | 8/1971 | Ris | 280/11.37 E |
| 3,747,947 | 7/1973 | Gunzel | 280/11.13 F |
| 4,221,400 | 9/1980 | Powers | 280/602 |
| 4,577,886 | 3/1986 | Chernega | 280/602 |
| 4,592,567 | 6/1986 | Saitor | 280/602 |

FOREIGN PATENT DOCUMENTS

| | | | |
|---|---|---|---|
| 218411 | 11/1961 | Austria | 280/602 |
| 3315638 | 1/1983 | Fed. Rep. of Germany . | |
| 3147140 | 6/1983 | Fed. Rep. of Germany | 280/602 |
| 1115843 | 1/1956 | France | 20/1 |
| 1433242 | 5/1965 | France | 280/602 |
| 214196 | 4/1941 | Switzerland . | |

*Primary Examiner*—Nancy A. Swisher

*Attorney, Agent, or Firm*—Owen, Wickersham & Erickson

[57] ABSTRACT

A ski with increased torsional stiffness while of normal flexural strength. A pair of substantially rigid rectilinear members that are stiff in torsion, are attached to the top of the ski by pivoted mounts that are rigidly secured to the ski. Two mounts lie to the rear of the ski's binding area, and two mounts lie in front of the binding area. The rigid members are mounted longitudinally of the ski, and the pivoting is transverse thereto. One mount of each pair of mounts is directly pivoted to its rigid member, while the other mount has an intermediate member pivoted transversely to the ski and also transversely pivoted at a point spaced therefrom to its rigid member.

18 Claims, 8 Drawing Figures

SKI WHICH IS STIFF IN TORSION AND RELATIVELY WEAK IN BEAM

This invention relates to an improved snow ski.

BACKGROUND OF THE INVENTION

Skis have various characteristics that affect the ease of skiing and the ability of the skier to achieve or fail to achieve a high level of proficiency. Thus, a good ski exhibits straight line stability at high speed, and also the ability to turn easily and to absorb bumps and ripples in the snow. In addition, it should show an ability to traverse across a steep slope without side slip.

Skis include a core, which may be made of various materials, such as wood, foam, honeycomb and various laminated materials. The core controls most of the resilience of the ski.

The bottom surface of the ski is made of a material which is slick, such as a suitable plastic that slides very well over the snow, and this is bonded to the bottom of the core.

The sides and the top may be of wood or of plastic or metal, but are usually of a type of material different from the bottom because slipping and sliding is not their function. The sides and top are also bonded to the core, and are preferably surrounded with a waterproof covering, which may also be decorative.

The bottom is usually provided with metal edges that function to cut into the ice or hard snow, so that the ski can bite and hold a turn without sliding sideways. These metal edges also help when traversing a slope and when the skier wishes to stop. The skier himself causes these metal edges to bite into the snow by angling his legs, and thus the skis, in the direction of the turn.

Good skis are usually narrower in the center than at the tips when viewed in plan, so that the sides to which the metal edges are affixed form a large arc. This arc helps to cause the ski to start turning when it is angled. The longer the portion of the metal edge that cuts into the snow, the more lateral force th ski can exert to enable ths skier to turn sharper and more quickly. Skis are limber and do not twist uniformly along their length when the skier angles them to turn.

Heretofore, such skis have been weak in torsion, so that the tips, the front, and the rear do not angle as much as the center, where the ski boot is attached as by bindings. This weakness in torsion forces the skier to accentuate the angularity of his legs, and the center of the ski does not achieve the same edge hold that would be obtained if the ski did not twist. such a twisted ski cannot exert the amount of force in a turn that an untwisted ski can, and is therefore a source of inefficiency.

Another important quality in skis is their compliance, their flexurability in the vertical direction. A highly compliant ski makes the ride smoother over the snow, enables the skier to maintain his balance more easily, and achieves a relatively even pressure distribution along the length of the ski, as applied to its bottom surface. Pressure along this bottom surface is a factor in making skis run fast. Areas of extreme pressure due to low compliance are certainly not desirable.

While a ski could be made to be very stiff in torsion by making it much thicker, it would then be much less compliant when moving over ripples and bumps and deep depressions in the snow. The overall result would then be very undesirable.

The compliance ability of a ski relates to its stiffness or flexibility in beam. It is desirable to have high compliance, and so it is desirable for a ski to be relatively weak in beam. On the other hand, twisting of the ski takes place because a typical ski is very weak in torsion. Both of the types of action may occur separately or simultaneously, depending on the terrain and on the action of the skier.

In the past, skis have been relatively weak in both beam and torsion. It is easy, as stated above, to make such a ski stiff in both beam and in torsion, but it has been nearly impossible to make the ski weak in beam, and yet stiff in torsion, and yet that is what is basically desired in a ski.

An object of the present invention is to accomplish stiffness in torsion while leaving the beam flexible, or relatively weak, so that the beam strength is relatively low, but the torsion stiffness is high.

Another object of the invention is to enable a designer to control, almost independently, each of the two factors, torsion and beam strength. Usually, this will be effected by starting with a ski design that is weak in beam and weak in torsion, and by applying the principles of the present invention to increase the torsional rigidity without substantially affecting the beam flexibility.

SUMMARY OF THE INVENTION

The present invention may start with a ski of typical good current design. Such a ski is relatively weak (or flexible), both in beam and in torsion. On top of this ski, possibly extending down into part of the core but generally on the upper surface, are provided a pair of longitudinally extending members that are stiff in torsion. The degree of such stiffness in torsion is controlled by the material from which the tubular members are made and by their diameter and wall thickness. They are mounted pivotally, with the pivots extending transversely of the ski. Preferably, such members are tubular to get better stiffness per weight; and there are two such tubular members, one located ahead and one behind the area where the user's boot is attached, that is, the ski binding area. In each instance there is a pair of mounting means for each tubular member. One mount is held rigidly on the ski, and the tubular member is pivoted to it. The other mount of each pair, however, includes an intermediate member pivotally mounted to the ski body, and also, by a separate pivot spaced from the first one, pivotally mounted to the tubular member.

As the ski flexes in beam, the resultant linkage moves on its pivots and offers no resistance; however, when the ski is subjected to a high torque or any twisting force, its pivots are at right angles to the direction of the twist, so that it resists twist. As a result, it imparts this stiffness in torsion to the ski itself, resulting in a ski that is relatively stiff in torsion, while still being relatively weak or flexible in beam.

Other objects and advantages of the invention will appear from the following description of the preferred embodiment.

DESCRIPTION OF A PREFERRED EMBODIMENT

Figures 1, 2, 3, 4:
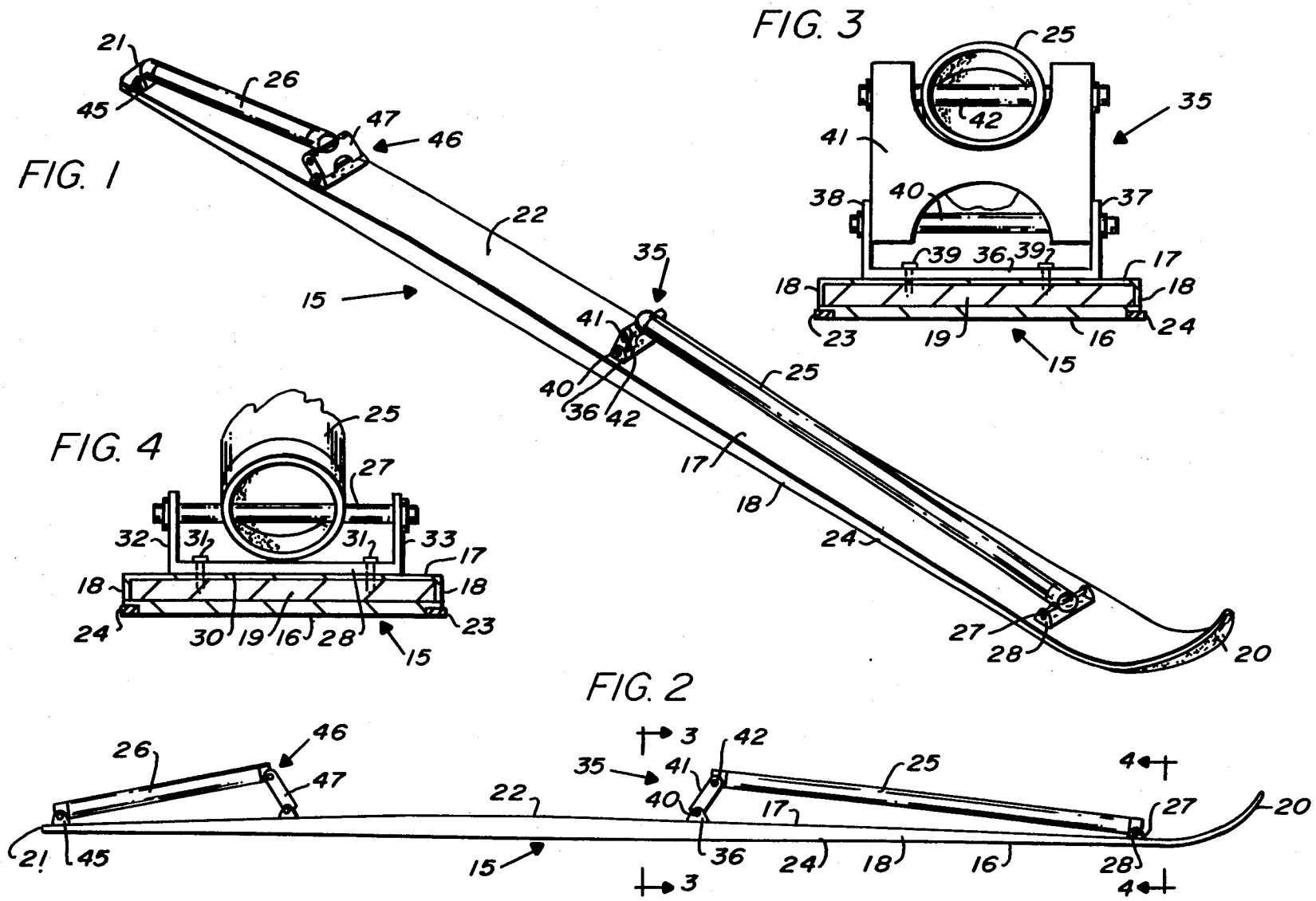
FIG. 1 is a simplified view in perspective of a ski embodying the principles of the invention.
FIG. 2 is a view in side elevation of the ski of FIG. 1, with the pivoted tubes in one position.
FIG. 3 is an enlarged view in section taken along the line 3—3 in FIG. 2.
FIG. 4 is a view in section taken along the line 4—4 in FIG. 2.

FIGS. 1–5 show a ski body 15 having a slick bottom surface 16, a top surface 17, and side surfaces 18, the top and side surfaces helping to protect a core 19, which is indicated in FIG. 3. The ski has a turned-up forward end 20 and a rear end 21. In between these two ends is an area 22 for placing the boot and bindings. It will be noted that the ski is wider at its front end 20 and at its rear end 21 than at the area 22 in between, for reasons already described above. Along the bottom edges are sharp metal inserts 23 and 24 (FIGS. 3 and 4).

The present invention provides a rigid rectilinear forward member 25 and a rigid rectilinear rear member 26. These may be solid, but better stiffness per weight is generally obtained when the members 25 and 26 are tubular and are made of suitable plastic or of metal. For the sake of lightness, plastic is usually preferred. For example, it may be fiberglass structure, such as an epoxy resin tube filament wound with glass fibers. Absolute rigidity is not required, but substantial rigidity is employed. The forward member 25 is pivotally mounted by a pivot pin 27 to a forward supporting member 28, as shown best in Fig. 4. It will be seen that the member 28 is generally U-shaped with a bottom surface 30 secured as by screws 31 to the upper surface 17 of ski 15, (although it could be made to be secured to the sides of the ski) and with upstanding arms 32 and 33 which are provided with openings to receive the pivot member 27, which also passes through openings near the forward end of the tubular member 25. Thus, the tubular member 25 is mounted on transverse pivots relative to the ski 15.

At the rear of the forward tubular member 25 is another mounting member 35 (FIG. 3) that has a generally U-shaped bottom member 36 with two side arms 37 and 38 which extend upwardly. Screws 39 hold the bottom member 36 to the ski 15. A pivot pin 40 extends across between the arms 37 and 38, the pin 40 may be stationary or may float. However, in this instance the pivot pin 40 is not connected directly to the tubular member 25. Instead, an intermediate linkage 41 is pivoted to the ski 15 by the pivot member 40. At the upper end of the intermediate linkage 41, an additional pivot pin 42 passes transversely through the rear end of the tubular member 25 and across the intermediate linkage 41. Thus the linkage is pivoted relative to the ski 15 itself, and the tube 25 is pivoted relative to the linkage 41.

The rear tubular member 26 is similarly pivotally mounted on a member 45 which corresponds to the member 28 shown in FIG. 4, and may be substantially identical to it. There is also a member 46 corresponding to the member 35 shown in FIG. 3 and, like it, having an intermediate linkage 47. The members 46 and 47 may be substantially identical to the members 35 and 41. If desired, they could be secured to the sides of the ski instead of its upper surface.

Figure 5:
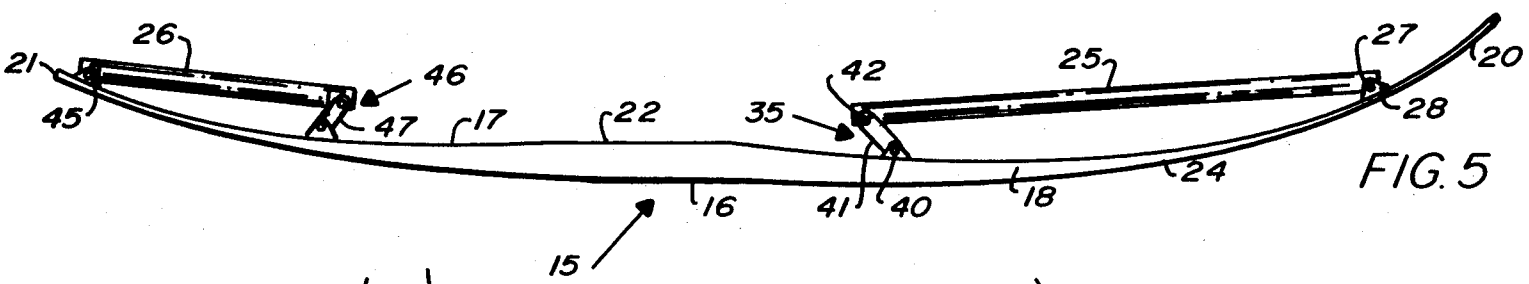
FIG. 5 is a view in side elevation like that of FIG. 2, with the pivoted tubes in a different position, due to some flexure of the ski.

During operation, the members 28, 35, 45, and 46 and the tubes 25 and 26 have no substantial effect on the up-and-down flexure of the ski 15, as can be seen in FIGS. 2 and 5. However, these members and tubes stiffen the ski 15 in torsion. The desired torsional stiffness is therefore obtained.

Figure 7:
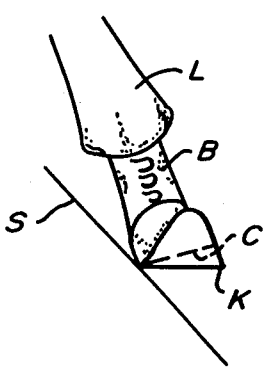
FIG. 7 PRIOR ART
FIG. 7 is a similar view of a prior art ski, where the leg has to be angled in toward the slope, the broken line showing the sole of the boot to compensate for the twist of the ski between the boot and the ski so that the front of the ski can run at a good cutting angle relative to the slope.
Figure 6:
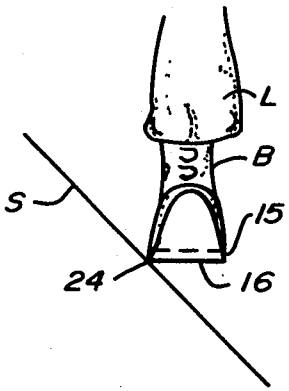
FIG. 6 is a diagrammatic view in front elevation showing the adaptability of the ski of the present invention to the slope.
Figure 8:
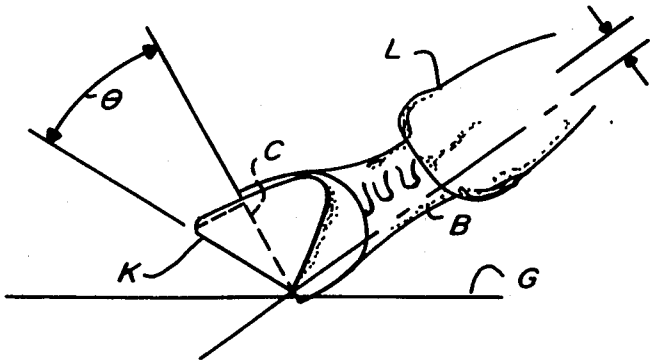
FIG. 8 PRIOR ART
FIG. 8 is a diagrammatic view of a prior art ski where the leg must be angled away from a level path, the angle $\theta$ being that between the sole of the boot and the ski, showing the twist of the ski.

Some effects of the invention are shown by FIGS. 6 (representing the invention) and FIGS. 7 and 8 (representing the prior art). FIGS. 6 and 7 show a slope S. A ski 15 of the present invention is shown in FIG. 6, while in FIG. 7 a prior-art ski K is shown. Both figures show a portion of a skier's leg L and his boot B. The skier is traversing the slope S, and the edge 24 of the ski 15 (in FIG. 6) engages the slope. The members 25 and 26 (FIGS. 1–5) impart torsional stiffness to the ski 15, so that in FIG. 6, the skier's leg L is vertical and the boot B is vertical with its sole and the bottom surface 16 of the ski 15 parallel and horizontal. In contrast, the ski K in FIG. 7 lacks torsional stiffness. The ski K is weak in torsion, is much too flexible. The skier has to have his leg L inclined to the vertical, and the sole C of his boot B is at a marked angle relative to the bottom of the ski K.

In FIG. 8, the skier is making a turn on horizontal snow-covered ground G. There is a substantial angle $\theta$ between the sole C of his boot B and the bottom of the ski K. With applicant's invention the angle $\theta$ would be zero, making skiing much easier and more effective.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A ski that is stiff in torsion and is flexible in the vertical direction, comprising a ski with a bottom surface and a top surface, a curved-up front end, a rear end, and a ski binding area in between its ends for affixation of a user's ski boot, a pair of substantially rigid rectilinear members that are stiff in torsion, and a series of mounting means rigidly secured on said ski defining pivoting means for pivotally mounting said rigid members about two axes transverse to said ski, comprising one pair of mounting means to the rear of said binding area for mounting a rear said rigid member and one pair of mounting means in front of said binding area for mounting a forward said rigid member, said rigid members being mounted longitudinally of said ski, all the pivoting being about the two axes transverse to the longitudinal axis of said ski, one said pivoting means of each said two mounts being directly pivoted to its said rigid member about an axis tangential to the longitudinal axis of said ski, the other said pivoting means having an intermediate member pivoted about an axis transverse to said ski and also pivoted about an axis tangential to the longitudinal axis of said ski at a point spaced therefrom to its said rigid member.

2. The ski of claim 1 wherein said substantially rigid members are stiff plastic tubes.

3. The ski of claim 1 wherein said substantially rigid members comprise metal tubes.

4. The ski of claim 1 wherein said mounting means are secured on top of the ski.

5. A ski with increased beam stiffness in torsion, compared with typical skis, while being relatively weak in beam comprising a ski with a bottom surface secured to a core lying thereabove, a top surface and side surfaces secured to said core, a curved-up front end, a rear end, and a ski binding area in between for affixation of a user's ski boot, a pair of substantially rigid rod-like members that are stiff in torsion, and a series of mounting means rigidly secured to said ski above said bottom surface, defining pivoting means for pivotally mounting said rigid members to said ski about two axes transverse to said ski, said mounting means comprising a first pair of mounting means to the rear of said binding area for mounting a rear said rigid member and a second pair of mounting means in front of said binding area for mounting a forward said rigid member, said rigid members being mounted longitudinally of said ski and pivoted about the two axes transverse to the longitudinal axis of said ski, one said pivoting means of each said pair being directly pivoted to its said rigid member about an axis tangential to the longitudinal axis of said ski, the other pivoting means of each said pair incorporating an intermediate member pivoted about an axis transverse to said ski and also pivoted about an axis tangential to the longitudinal axis of said ski at a point spaced therefrom to its said rigid member.

6. The ski of claim 5 wherein said rigid rod-like members are stiff plastic tubes.

7. The ski of claim 5 wherein said rigid rod-like members are stiff metal tubes.

8. The ski of claim 6 wherein said mounting means are mounted on top of said ski.

9. An assembly for attachment to a normal ski, which is weak in both beam and torsion, for increasing its stiffness in torsion, comprising a pair of substantially rigid rectilinear members that are stiff in torsion, and mounting means adapted to be rigidly secured on a normal ski and to provide pivot means for pivotally mounting said rigid members along two axes transverse to the longitudinal axis of said ski, comprising one pair of mounting means for use at the rear of the ski and another pair of mounting means for use at the front part of the ski, each said rigid member being mounted longitudinally of said ski, the pivoting being along the two axes at right angles to the longitudinal axis of said ski, one said pivoting means of each said pair being directly pivoted along said transverse axis in a direction tangential to the longitudinal axis of said ski and to its said rigid member, the other pivoting means having an intermediate member adapted to be pivoted along an axis transverse to said ski and also pivoted along an axis tangential to the longitudinal axis of said ski at a point spaced therefrom transversely to its said rigid member.

10. The assembly of claim 9 wherein each said rigid member is a stiff plastic tube.

11. The assembly of claim 9 wherein each said rigid member is a metal tube.

12. A ski that is stiff in torsion and is flexible in the vertical direction, comprising a ski with a bottom surface and a top surface, a curved-up front end, a rear end, and a ski binding area in between its ends for affixation of a user's ski boot, at least one substantially rigid rectilinear member that is stiff in torsion, and a pair of mounting means rigidly secured on said ski defining pivoting means for pivotally mounting said rigid member longitudinally of said ski, the pivoting being along two axes transverse to the longitudinal axis of said ski, one said pivoting means being directly pivoted to said rigid member, the other said pivoting means having an intermediate member pivoted along an axis transverse to said ski and also pivoted along an axis tangential to the longitudinal axis of said ski at a point spaced therefrom to said rigid member.

13. The ski of claim 12 wherein said substantially rigid member comprises a stiff plastic tube.

14. The ski of claim 12 wherein said substantially rigid member comprises a metal tube.

15. The ski fo claim 12 wherein said mounting means are secured on top of the ski.

16. An assembly for attachment to a normal ski which is weak in both beam and torsion, for increasing its stiffness in torsion, comprising a substantially rigid rectilinear member that is stiff in torsion, and mounting means adapted to be rigidly secured on said ski and defining pivoting means for pivotally mounting said rigid member longitudinally of said ski, the pivoting being along two axes at right angles to the longitudinal axis of said ski, one said pivoting means being directly pivoted along an axis transverse to said rigid member, the other pivoting means having an intermediate member adapted to be pivoted along an axis transverse to said ski and also pivoted at a point spaced therefrom along an axis tangential to the longitudinal axis of said ski.

17. The assembly of claim 16 wherein each said rigid member is a stiff plastic tube.

18. The assembly of claim 16 wherein each said rigid member is a metal tube.

* * * * *